United States Patent [19]

Macemon et al.

[11] 4,010,437

[45] Mar. 1, 1977

[54] FUSE HOLDERS FOR TRANSFORMERS

[75] Inventors: Herbert J. Macemon, Versailles, Ky.; Vance Martin, Charlotte, N.C.; John L. Fisher, Lexington, Ky.

[73] Assignee: Kuhlman Corporation, Troy, Mich.

[22] Filed: Aug. 26, 1974

[21] Appl. No.: 500,584

[52] U.S. Cl. ..... 337/204; 337/186; 337/205

[51] Int. Cl.[2] ..... H01H 85/02

[58] Field of Search ..... 200/149 A; 337/186, 337/194, 197, 204, 205; 339/126 R, 126 RS, 255 RT, 256 RT, 94 A

[56] References Cited

UNITED STATES PATENTS

| | | | |
|---|---|---|---|
| 1,505,531 | 8/1924 | Bensett | 339/256 RT |
| 1,668,381 | 5/1928 | Schild | 339/256 RT |
| 1,824,804 | 9/1931 | Douglas | 339/256 RT X |
| 1,873,042 | 8/1932 | Rohrdanz | 339/256 RT |
| 2,918,557 | 12/1959 | Link | 337/204 X |
| 2,975,254 | 3/1961 | Yanagisawa | 339/255 RT |
| 3,829,810 | 8/1974 | Giegerich | 337/205 |

*Primary Examiner*—J. D. Miller
*Assistant Examiner*—Fred E. Bell
*Attorney, Agent, or Firm*—Harness, Dickey & Pierce

[57] ABSTRACT

A fuse holder for a transformer comprising a generally tubular housing secured at one end to the transformer end wall and enclosing the fuse. A tapered resilient adapter sleeve is disposed within the outer end of the housing and carries a bushing well for a high voltage line adapter. The adapter sleeve seals the housing interior. An annular clamp secured to the transformer wall holds the adapter sleeve and fuse holder housing in place. The inner end of the air type fuse is connected to the transformer primary winding by a helical coil spring compressed between a projection on the fuse and a stainless steel tube. The fuse and bushing well are removable by detaching a clamp ring on the outside of the transformer and slipping the parts out through the adapter sleeve and housing. The construction permits immersion of the air type fuse and insures isolation and de-energization of the internal transformer parts upon opening of the fuse.

10 Claims, 3 Drawing Figures

FUSE HOLDERS FOR TRANSFORMERS

BACKGROUND OF THE INVENTION

The invention relates to transformers, and more particularly to means for mounting an air type fuse for the high voltage line at the front plate of the transformer so that line parts internal to the transformer will be isolated upon opening of the fuse.

BRIEF SUMMARY OF THE INVENTION

It is an object of the invention to provide a novel and improved fuse holder which may be applied to various kinds of transformers, particularly distribution transformers, and permits an air type fuse to be mounted below the oil level.

It is another object to provide a novel feed-through current limiting fuse holder of this type which effectively seals the fuse from the outside environment and prevents arcing from the live parts to the grounded front plate.

It is a further object to provide an improved fuse holder of this type which permits easy service removal of the bushing well and fuse.

It is another object to provide an improved fuse holder of this character which incorporates novel means for connecting the fuse to the transformer primary winding.

In summary, the fuse holder of this invention comprises a generally tubular housing of dielectric material enclosing an air type fuse, the outer end of this housing passing through an apertured portion of the transformer front plate, means securing the outer end of the housing to the front plate, an adapter sleeve of resilient material mounted within the outer end of the housing, the inner surface of this adapter sleeve being slightly tapered in an inward direction, a bushing well with a complementary taper disposed within said adapter sleeve, means connecting said bushing well to the fuse, and means removably clamping the bushing well in compressed relation with the adapter sleeve, whereby removing said last-mentioned means will permit the bushing well and fuse to be withdrawn from the housing and adapter sleeve.

The invention further comprises a fuse holder having a housing of generally cylindrical shape enclosing an air type fuse, the outer end of said housing passing through an apertured portion of the transformer front wall, a flange on the housing outer end, and means clamping said flange to the front wall in sealing relation, said housing being fabricated of glass fiber reinforced epoxy.

Further, the fuse holder comprises a housing of generally cylindrical tubular shape enclosing an air type fuse, the housing being fabricated of dielectric material, an electrically conductive end plate on one end of the housing, and means electrically connecting the adjacent end of said fuse to said end cap comprising a projection on the fuse, a metallic sleeve surrounding said projection and contacting the outer edges of said end cap, and an electrically conductive helical coil spring pressed between said electrically conductive projection and sleeve.

DESCRIPTION OF THE PREFERRED EMBODIMENT

Figure 1:
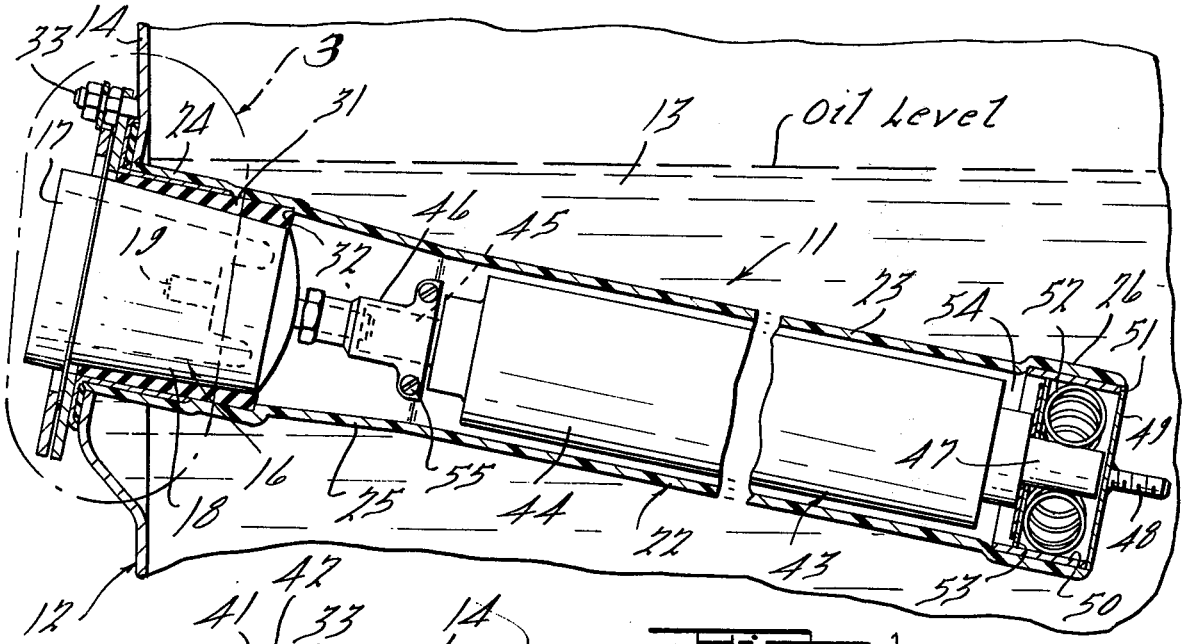
FIG. 1 is a cross-sectional view in elevation showing the fuse holder.
Figure 2:
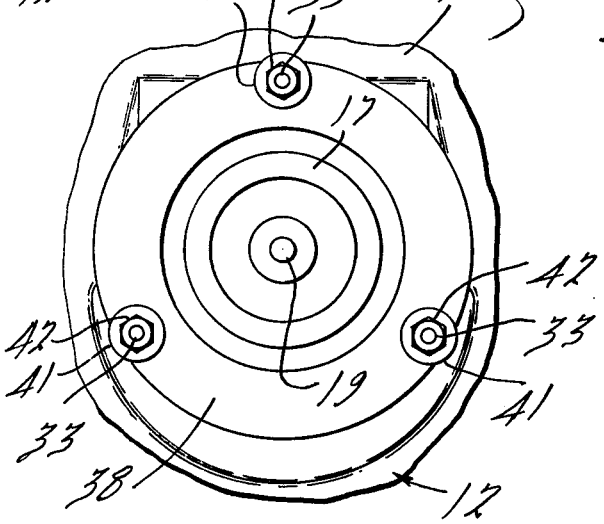
FIG. 2 is a front elevational view showing the bushing well clamp.
Figure 3:
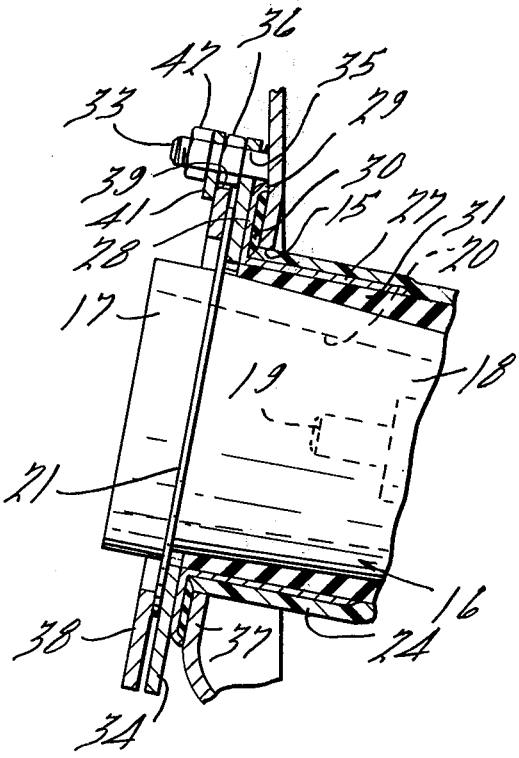
FIG. 3 is an enlarged side cross-sectional view in elevation taken in the area marked 3 of FIG. 1 showing further details of the parts.

The fuse holder of this invention is generally indicated at 11 and is shown as being installed in a transformer shown partially and indicated generally at 12. This transformer has primary and secondary windings (not shown) immersed in an oil bath 13 and enclosed by a housing having a front wall or plate 14. The front plate is provided with an apertured portion 15 in which is disposed a bushing well generally indicated at 16. This well is preferably constructed of an insulative material such as an epoxy resin and has an outer portion 17, a tapered main portion 18, and a central terminal 19 for connection to the high voltage line. A recess 20 is provided in bushing well 16 for receiving the high voltage line, and a radial mounting flange 21 is disposed between portions 17 and 18 of the well. The mounting flange may be of a metallic material such as stainless steel.

The fuse holder itself comprises a housing generally indicated at 22 fabricated of an insulative material such as a glass fiber reinforced epoxy. The fuse holder is shown as being immersed in oil bath 13 and has a main cylindrical portion 23 and an enlarged portion 24 passing through apertured portion 15. A slightly tapered portion 25 connects enlarged portion 24 with the main portion 23 of the housing, and the inner end of the housing has another enlarged portion 26.

A fuse holder top assembly comprising a sleeve 27 within housing portion 24 and a flange 28 secured to sleeve 27 are mounted on the outer end of the fuse holder. Flange 28 is disposed on the forward side of front plate 14 and has an outer edge 29 bent back and facing the front plate to retain a gasket 30. Sleeve 27 and flange 28 are preferably fabricated of metallic material such as stainless steel, with gasket 30 suitably formed of an elastomer compound. Sleeve 27 is disposed in a recess within housing portion 24 so that the inner surface of the sleeve is flush with the remaining part of housing portion 24.

An adapter sleeve 31 surrounds main portion 18 of bushing well 16 and acts as an electrically insulative seal between the bushing well and portion 24 of the fuse holder housing. This sleeve is preferably fabricated of a material which is resilient and acts as a dielectric medium. The inner surface of adapter 31 has a taper complementary to that of bushing well portion 18. When the bushing well is clamped into position within adapter sleeve 31, in a manner described below, the taper of the bushing well will compress the adapter sleeve to seal the inside of the fuse holder from the outside environment and prevent arcing from the live parts within the fuse holder to the grounded front plate. A shoulder 32 between portions 23 and 24 of the fuse holder housing will limit inward movement of the adapter sleeve 31 when the bushing well is clamped in position.

The means for securing the fuse holder comprises a plurality of circumferentially spaced studs 33 secured to and extending forwardly from front plate 14 of the transformer immediately outwardly of flange 28. A fuse holder clamp 34 in the form of an annular flat disc has apertured portions 35 for the reception of studs 33 and rests against flange 28. Nuts 36 placed on studs 33 will force clamp 34 against flange 28. The portion 37 of front plate 14 which faces flange 28 is flat so that gasket 30 will be compressed to keep the transformer oil from leaking out. The diameter of the bore of clamp 34 is less than the outer diameter of the adapter sleeve 31 such that it will overlap the adapter sleeve 31 to retain the adapter sleeve 31 in position on removal of the bushing well 16.

A bushing well clamp 38 in the form of an annular disc overlies flange 21 of bushing well 16. This clamp has recesses 39 for accommodating nuts 36 and is secured in position by washers 41 and nuts 42.

The air type fuse within fuse holder housing portion 23 is generally indicated at 43 and has a main portion 44 of cylindrical shape. The forward end has a relatively narrow terminal portion 45 connected to terminal 19 of bushing well 16 by an attachment device 46. Means are provided for electrically connecting the relatively narrow inner terminal 47 of fuse 43 to a threaded terminal 48 which leads to the transformer primary winding. Terminal 47 is of such a length as to remain in a slightly spaced apart relation to the end cap 49 when the fuse and bushing well assembly is clamped in position as shown in FIG. 1. Terminal 48 is welded to a disc-like metallic cap 49 fitting within end 26 of the fuse holder housing. A metallic sleeve-like contact tube 50 fits within housing portion 26. Parts 49 and 50 may be fabricated of stainless steel welded to each other at their juncture 51. Part 49 acts as the fuse holder bottom while part 50 is the contact element for the inner end of the fuse.

A helical coil contact spring 52 is provided between terminal 47 of the fuse and contact 50. This spring may be fabricated of a conductive material such as phosphor bronze wire, and its ends are preferably united by a crimp connector (not shown). When in place, the radial compression on the contact spring will complete the electrical path from fuse 43 to terminal 48. A retainer ring 53 is secured within contact 50 and is disposed between spring 52 and the space 54 within the fuse holder housing to retain the spring in place when the fuse is being removed.

In operation, to remove fuse 43 it is merely necessary to remove nuts 42 and washers 41 which will permit bushing well clamp 38 to be removed. Bushing well portion 17 may then be grasped by the operator's fingers and the bushing well along with fuse 43 withdrawn from housing 22. Contact spring 52 and retainer ring 53 will stay in place. In order to remove the fuse from the bushing well, screws 55 on attachment device 46 will be loosened.

We claim:

1. In a fuse holder for a transformer having a front plate, a housing of dielectric material for enclosing a fuse, the outer end of this housing passing through an apertured portion of the transformer front plate, means securing the outer end of the housing to the front plate, an adapter sleeve of resilient material mounted within the outer end of the housing, the inner surface of this adapter sleeve being tapered in an inward direction, a bushing well with a complementary taper disposed within said adapter sleeve, means connecting said bushing well to a fuse, and means removably clamping the bushing well in compressed relation with the adapter sleeve, whereby removing said clamping means will permit the bushing well and fuse to be withdrawn from the housing, said clamping means comprising a flange on said bushing well, a disc like clamp engaging said flange, a plurality of studs secured to said front wall, and nuts on said studs engaging said clamp.

2. The combination according to claim 1, said housing securing means comprising a flange on said housing, a gasket between said housing flange and front plate, a disc-like fuse holder clamp, and nuts on said studs holding said fuse holder clamp against said housing flange.

3. The combination according to claim 2, the dimensions of said fuse holder clamp being such that it is in overlapping relation for retention of said adapter sleeve.

4. The combination according to claim 2, further provided with a sleeve within said outer end of the housing, said sleeve and housing flange being connected and fabricated of metallic material.

5. The combination according to claim 1, further provided with an electrically conductive end cap on the inner end of the housing, and means electrically connecting the adjacent end of said fuse to said end cap comprising a electrically conductive projection on the fuse, a metallic contact sleeve surrounding said electrically conductive projection and connected to the outer edge of said end cap, and an electrically conductive helical coil compression contact spring compressed between said electrically conductive projection and contact sleeve.

6. In a fuse holder for a transformer having a front plate, a housing of generally cylindrical shape enclosing an air type fuse, the outer end of said housing passing through an apertured portion of the transformer front wall, a flange on the housing outer end, a gasket between said flange and front plate, said housing being fabricated of a dielectric material, one or more studs on said front wall, a disc-like clamp engaging said flange, one or more apertures in said disc-like clamp spaced so as to align with said studs, and nuts on said studs securing said clamp, flange, and gasket in sealing relation to said front wall.

7. In a fuse holder for a transformer, a housing of generally tubular shape enclosing an air type fuse, the housing being fabricated of dielectric material, an electrically conductive end plate on the inner end of the housing and means electrically connecting the adjacent end of said fuse to said end plate comprising an electrically conductive projection on the fuse, an electrically conductive metallic contact sleeve surrounding said projection and connected to the outer edge of said end cap and extending a predetermined distance into said cylindrical housing, said distance being slightly greater than the length of said projection, an electrically conductive helical coil compression contact spring compressed between said electrically conductive projection and contact sleeve, and a retaining ring secured to said contact sleeve between said fuse and said helical spring, said retaining ring having a center aperture slightly larger than the diameter of said projection.

8. The fuse holder as set forth in claim 7 wherein the projection on said fuse is of a length to fully engage said spring and remain in a spaced apart relationship from said end cap.

9. In a fuse holder for a transformer having a front plate, a housing of generally cylindrical shape enclosing an air type fuse, the outer end of said housing passing through an apertured portion of the transformer front plate, a flange on the housing outer end, a gasket between said flange and said front plate, means to confine said gasket's radial expansion, a plurality of studs attached to said front plate, a disc-like clamp engaging said flange, nuts on said studs clamping said clamp, flange, gasket and front plate in a sealed relationship, an adapter sleeve disposed in the outer end of said housing, said disc-like clamp having a bore of a diameter less than the outside diameter of said sleeve and engaging the outer edge of said sleeve thereby securing said sleeve in said housing, a bushing well disposed inside of said adapter sleeve and protruding outward therefrom, a flange on said bushing well, a second disc-shaped clamp engaging said flange and a second set of nuts on said studs securing said clamp which secures said flange in engagement with said first disc like clamp.

10. A fuse holder as set forth in claim 9 further comprising an electrically conductive projection on said fuse, an electrically conductive end plate on the inner end of said housing, an electrically conductive contact sleeve surrounding said projection and disposed along the inside wall of said housing, said contact sleeve being electrically connected to said end plate, and electrically conductive helical coil compression contact spring compressed between said projection and said contact sleeve, a retaining ring between said contact spring and the fuse body to hold said contact spring in position and having a centrally located aperture of a diameter slightly larger than the diameter of said projection, and said projection being of such a length as to pass through said apertured retaining ring and fully engage said contact spring but remain in a spaced apart relationship to said end cap.

* * * * *